US005357233A

United States Patent [19]

Wada

[11] Patent Number: 5,357,233

[45] Date of Patent: Oct. 18, 1994

[54] IGNITION APPARATUS FOR INTERNAL COMBUSTION ENGINE

[75] Inventor: Zyunichi Wada, Aichi, Japan

[73] Assignee: Nippondenso Co., Ltd., Kariya, Japan

[21] Appl. No.: 928,013

[22] Filed: Aug. 11, 1992

[30] Foreign Application Priority Data

Aug. 23, 1991 [JP] Japan ..... 3-212464
Jun. 1, 1992 [JP] Japan ..... 4-140703

[51] Int. Cl.[5] ..... H01F 27/04

[52] U.S. Cl. ..... 336/107; 336/198; 336/208; 336/105; 123/634

[58] Field of Search ..... 336/107, 105, 198, 208, 336/185, 92; 123/634

[56] References Cited

U.S. PATENT DOCUMENTS 3,008,108 11/1961 Baker et al. ..... 336/185
3,230,489 1/1966 Weyrich ..... 336/208 X
4,985,984 1/1991 Umezaki ..... 336/107 X
5,041,807 8/1991 Badaud ..... 336/105 X
5,170,767 12/1992 Wada et al. ..... 123/634 X

FOREIGN PATENT DOCUMENTS 153408 9/1982 Japan ..... 336/208
63-177668 11/1988 Japan .
64-8580 1/1989 Japan .
3257908 11/1991 Japan .
2199193 6/1988 United Kingdom ..... 336/107

*Primary Examiner*—Leo P. Picard
*Assistant Examiner*—L. Thomas
*Attorney, Agent, or Firm*—Cushman, Darby & Cushman

[57] ABSTRACT

An ignition apparatus for an internal combustion engine, comprises, an ignition coil including a primary coil and a secondary coil for generating a peaked high-voltage output from an abrupt input-current decrease in the primary coil, and an extension device which extends from the ignition coil to supply the peaked high-voltage output to a spark plug, wherein a part of an outer periphery of the secondary coil at an intermediate position of the outer periphery of the secondary coil sinks in relation to the other part of the outer periphery of the secondary coil to form a groove extending in a radial direction of the secondary coil, the peaked high-voltage output is transmitted from the secondary coil through the groove to the extension device, and the extension device includes a first member extending from the ignition coil, a second member for being connected to the spark plug and an elastic member connecting the first member to the second member so that the first member moves elastically in relation to the second member.

17 Claims, 8 Drawing Sheets

IGNITION APPARATUS FOR INTERNAL COMBUSTION ENGINE

BACKGROUND OF THE INVENTION AND RELATED ART STATEMENT

The present invention relates to an ignition apparatus for an internal combustion engine, in which apparatus an input voltage applied to a primary coil thereof is converted to a high-voltage to be supplied to a spark plug.

Each of conventional ignition apparatus an disclosed in Japanese Utility Model Unexamined Publication Nos. 63-177668 and 64-8580 has a universal joint on a high-voltage connector extending between an ignition coil and a socket for a spark plug so that the high-voltage connector can be bent at the universal joint.

Another conventional ignition apparatus as disclosed in Publication of Japanese Patent Unexamined Publication No. 3-257908 has a bobbin in which a primary coil is arranged and on which a plurality of grooves are formed, an electrically conductive output terminal which is fixed to an end of the bobbin and is connected to a high-voltage terminal, and a secondary coil which is wound from another end of the bobbin to the end of the bobbin to be connected electrically to the output terminal at the end of the bobbin so that a high-voltage is supplied from the secondary coil to the high-voltage terminal.

OBJECT AND SUMMARY OF THE INVENTION

An object of the present invention is to provide an ignition apparatus whose high-voltage connector extending between an ignition coil and a spark plug can be bent easily and has a vibration-proof characteristic.

Another object of the present invention is to provide an ignition apparatus in which a high-voltage can be supplied from a desired position without a protrusion on a secondary coil of ignition coil to a high-voltage terminal.

According to the present invention, an ignition apparatus for an internal combustion engine, comprises, an ignition coil for generating a peaked high-voltage output from an abrupt input-current decrease, and extension means which extends from the ignition coil to supply the peaked high-voltage output to a spark plug, and which includes a first member extending from the ignition coil, a second member connected to the spark plug and an elastic member connecting the first member to the second member so that the first member can move elastically in relation to the second member.

Further, according to the present invention, an ignition apparatus for an internal combustion engine, comprises, an ignition coil including a primary coil and a secondary coil for generating a peaked high-voltage output from an abrupt input-current decrease in the primary coil, and extension means which extends from the ignition coil to supply the peaked high-voltage output to a spark plug, wherein a part of an outer periphery of the secondary coil sinks in relation to the other part of the outer periphery of the secondary coil to form a groove extending in a substantially radial direction of the secondary coil at an intermediate position of the outer periphery of the secondary coil, and the peaked high-voltage output is transmitted from the secondary coil through the groove to the extension means.

Since the extension means extends from the ignition coil to supply the peaked high-voltage output to the spark plug and includes the first member extending from the ignition coil, the second member connected to the spark plug and the elastic member connecting the first member to the second member so that the first member can move elastically in relation to the second member, according to the present invention, the elasticity of the extension means causes a free bend thereof and restrains a vibration thereof below a desired level.

Further, since the part of the outer periphery of the secondary coil sinks to form the groove extending in the substantially radial direction of the secondary coil at the intermediate position of the outer periphery of the secondary coil, and the peaked high-voltage output is transmitted from the secondary coil through the groove to the extension means, according to the present invention, the peaked high-voltage output can be supplied from a desired intermediate position of the groove on the secondary coil to the spark plug without a protrusion.

DETAILED DESCRIPTION OF PREFERRED EMBODIMENTS

Figure 1:
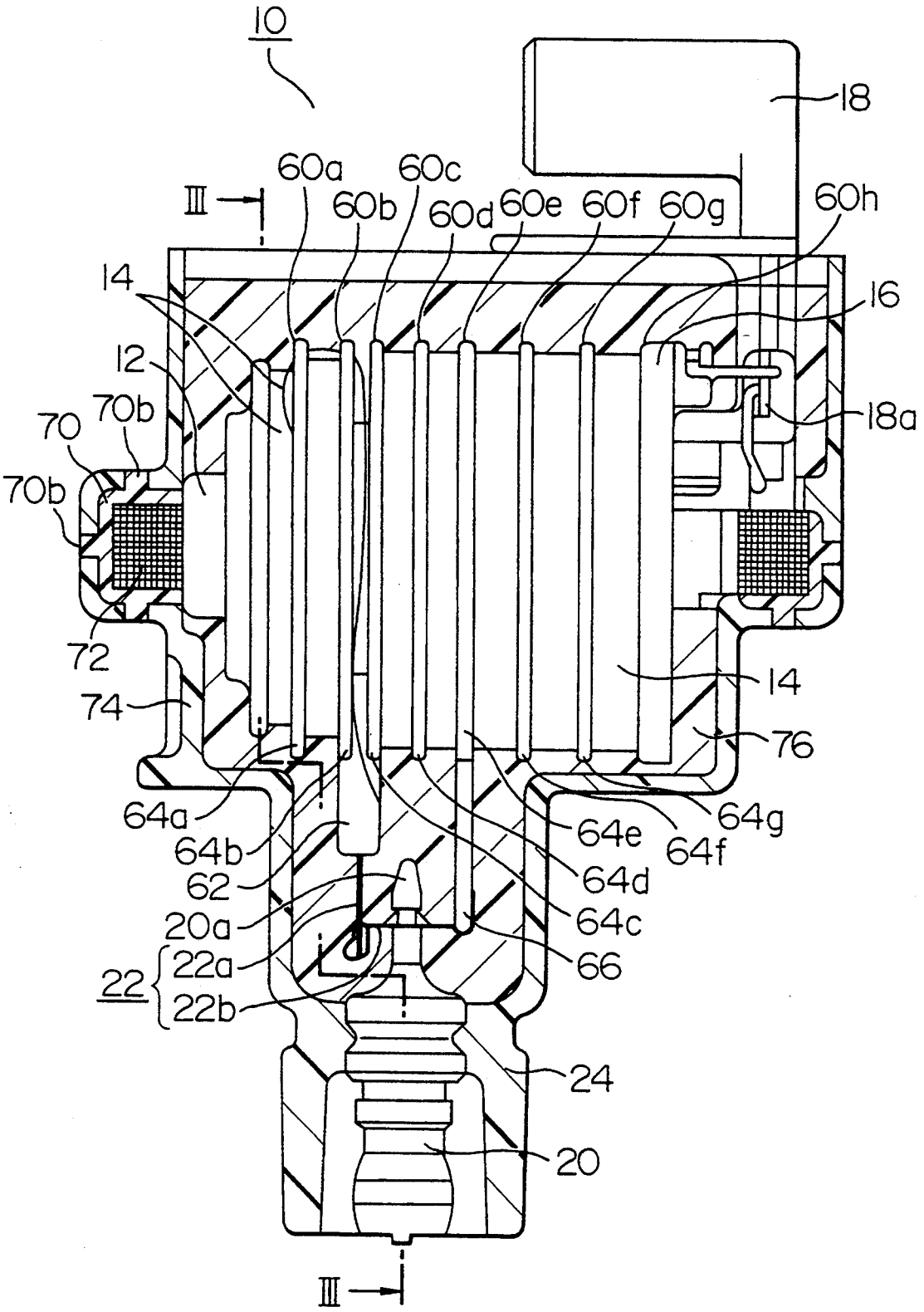
FIG. 1 is a partially cross-sectional enlarged view showing a part of an embodiment of the present invention.
Figure 2:
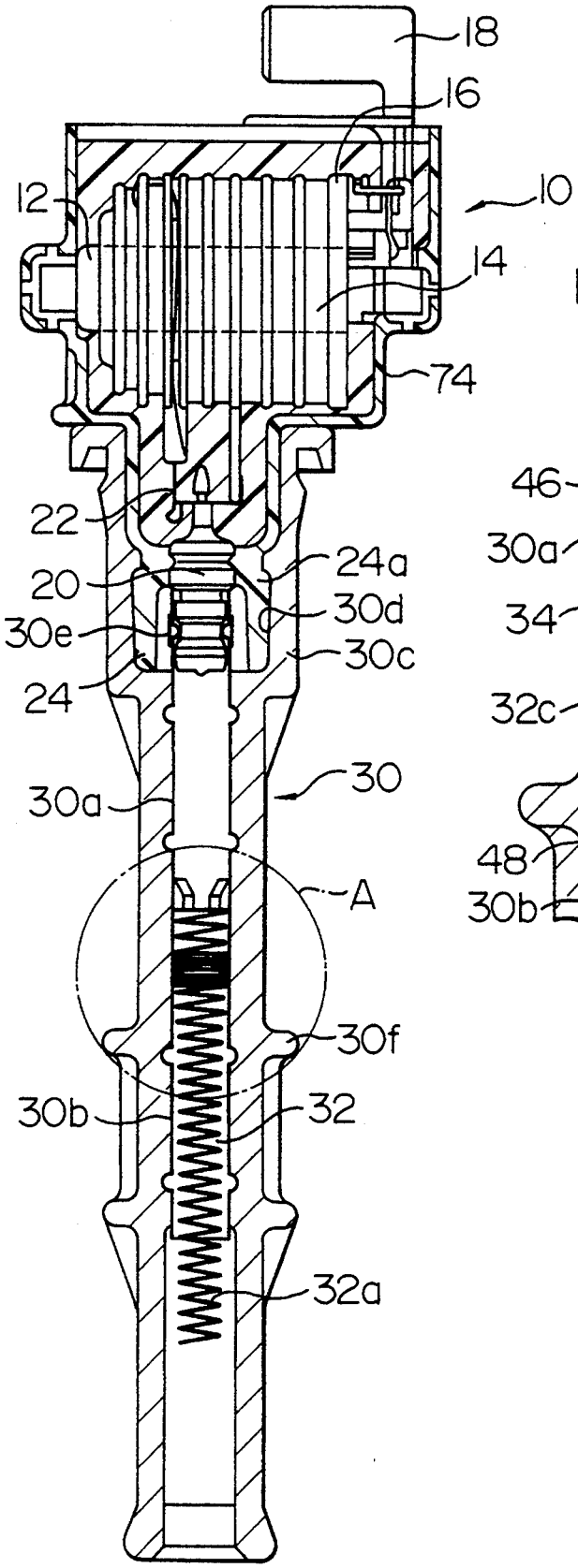
FIG. 2 is a partially cross-sectional view showing the entire of the embodiment of FIG. 1.
Figure 2A:
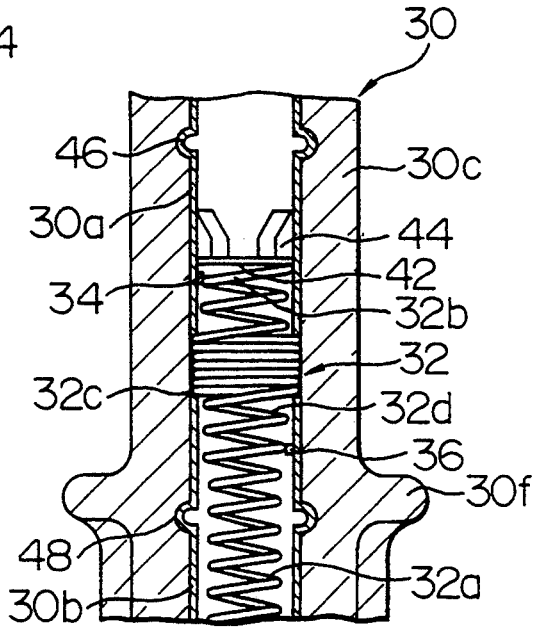
FIG. 2A is a partially cross-sectional enlarged view showing in detail a portion indicated by "A" in FIG. 2.
Figure 3:
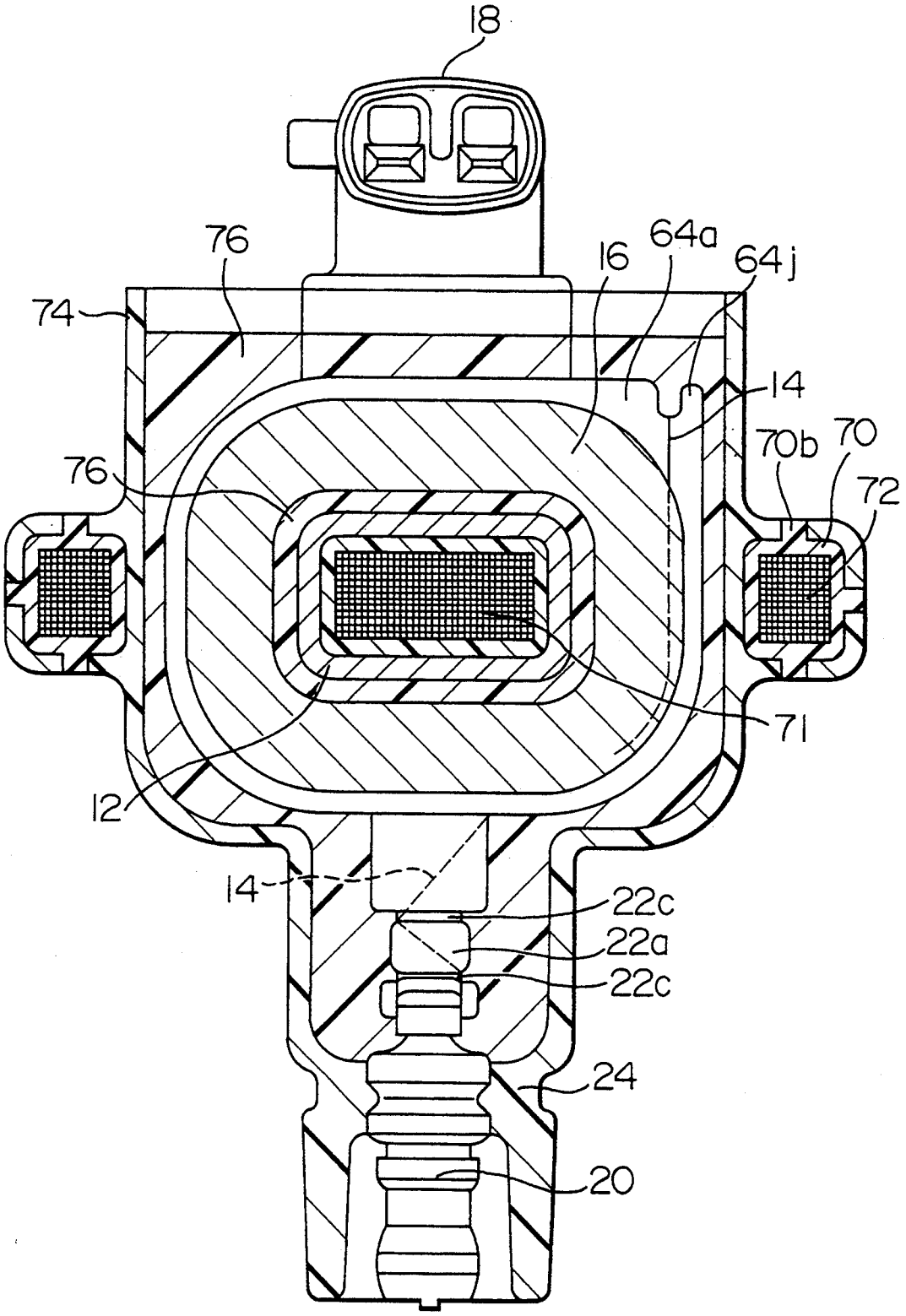
FIG. 3 is a cross-sectional view taken along a line III—III in FIG. 1.

FIGS. 1–3 show an ignition apparatus 10 according to the present invention. The ignition apparatus 10 includes a bobbin 16 in which a primary coil 12 is arranged and on which a secondary coil 14 is wound. An input connector 18 is arranged over the bobbin 16 to supply an electricity therethrough to the primary coil 12. A secondary terminal 22 is arranged below the bobbin 16 to supply a peaked high-voltage output from the secondary coil 14 to a high-voltage terminal rod 20 through which the peaked high-voltage output is transmitted to a high-voltage extension member 30 shown in FIG. 2. The high-voltage terminal rod 20 and the secondary terminal 22 are received in a high-voltage tower 24 projecting from a central portion of a bottom of an ignition coil frame 74.

Figure 7:
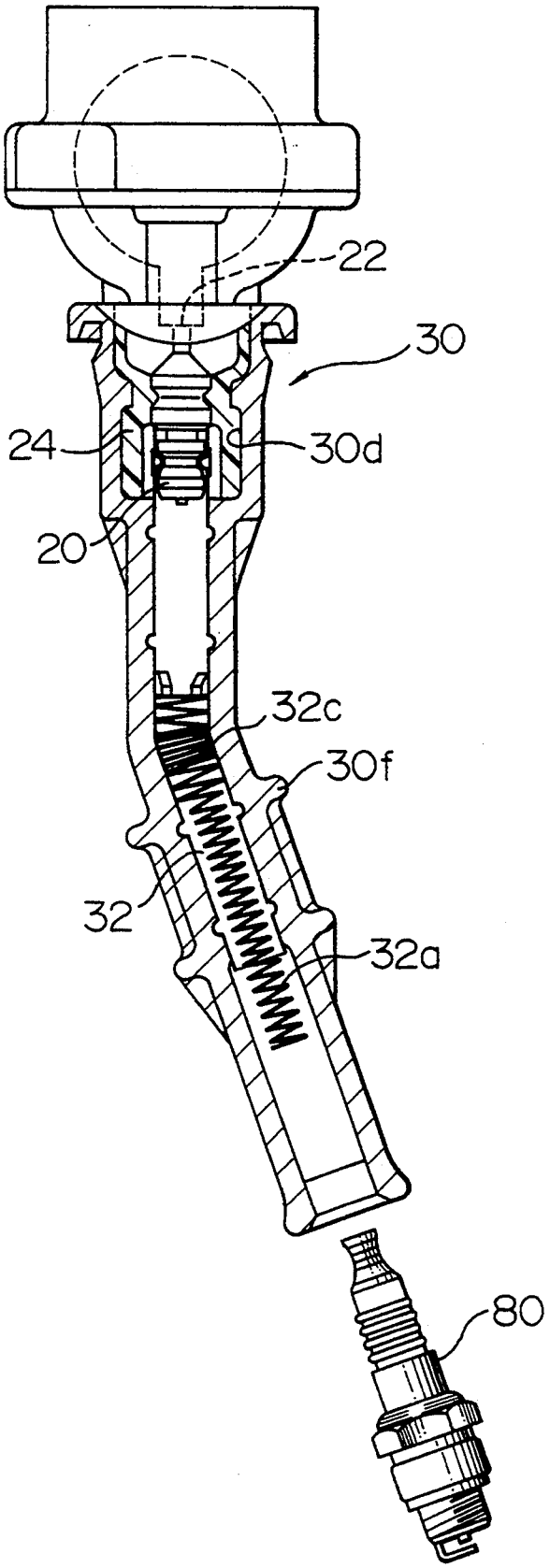
FIG. 7 is a partially cross-sectional view showing the embodiment of FIG. 2, in which view the embodiment is bent at an elastic member arranged therein.

The ignition coil frame 74 is fitted in the high-voltage extension member 30 for transmitting the peaked high-voltage output from the secondary coil 14 to a spark plug 80 (as shown in FIG. 7). The high-voltage extension member 30 includes a cylindrical electrically insulating rubber pipe 30c, first and second cylindrical metal members 30a and 30b which are arranged spaced from each other and fixedly in the rubber pipe 30c, and a coil spring 32. The coil spring 32 includes an end portion 32a for contacting with an electrode of the spark plug 80 to supply the peaked high-voltage output thereto, a spring portion 32b fitted and connected into the first cylindrical metal member 30a connected electrically to the high-voltage terminal rod 20, a spring portion 32d fitted and connected into the second cylindrical metal member 30b, and a spring portion 32c which can be bent freely and elastically between the first and second cylindrical metal members 30a and 30b. A cylindrical electrically insulating resin portion 24a of the high-voltage tower 24 is fitted into a cylindrical recess portion 30d of the rubber pipe 30c and contacts with a forward end ring spring 30e of the first cylindrical metal member 30a.

An outer diameter of the spring portion 32c is substantially equal to outer diameters of the first and second cylindrical metal members 30a and 30b which are fitted tight in the cylindrical electrically insulating rubber pipe 30c, and adjacent turns of the spring portion 32c contact tight with each other, so that a contraction of the high-voltage extension member 30 is prevented while the high-voltage extension member 30 is being set on the spark plug 80.

Therefore, the ignition apparatus 10 can be easily and securely mounted on the spark plug 80, although the high-voltage extension member 30 can be bent at the spring portion 32c as shown in FIG. 7. The high-voltage electricity is supplied to the spark plug 80 through the spring portion 32a. Outer diameters of the spring portions 32b and 32d are slightly smaller than inner diameters of the first and second cylindrical metal members 30a and 30b, and adjacent turns of the spring portions 32b and 32d do not contact with each other. Nails 34 and 36 projecting radially inwardly from inner surfaces of the first and second cylindrical metal members 30a and 30b engage with the spring portions 32b and 32d so that the coil spring 32 cannot be withdrawn from the inside of the first and second cylindrical metal members 30a and 30b. An outer diameter of the end portion 32a between a forward end of the coil spring 32 and the nail 36 is smaller than an inner diameter of the nail 36 so that the end portion 32a does not engage with the nail 36 when the coil spring 32 is inserted into the second cylindrical metal member 30b, and adjacent turns of the end portion 32a do not contact with each other. The end portion 32a projects from the second cylindrical metal member 30b toward the spark plug 80 to be inserted into the high-voltage extension member 30. A retainer washer 42 arranged at a forward end of the spring portion 32b engages with a plurality of embossments 44 projecting radially inwardly from an inner surface of the first cylindrical metal member 30a so that the coil spring 32 is positioned in relation to the first cylindrical metal member 30a. Embodiments 46 and 48 projecting radially outwardly from outer surfaces of the first and second cylindrical metal members 30a and 30b prevents the first and second cylindrical metal members 30a and 30b from being withdrawn from the rubber pipe 30c.

A plurality of projections 30f are arranged on an outer periphery of the rubber pipe 30c to guide the ignition apparatus 10 while being mounted on the spark plug 80 and to prevent a vibration of the ignition apparatus 10.

Input electricity is supplied through the connector 18 and a primary electrode 18a to the primary coil 12 arranged in the bobbin 16. The bobbin 16 has a plurality of grooves 60a–60h on an outer periphery thereof, and the secondary coil 14 formed by an electrically insulating layer coated copper line is wound in the channels 60a, 60b, 60d, 60e, 60f, 60g and 60h, is not wound in and only passes on the narrow channel 60c so that an outer periphery of the secondary coil 14 sinks to form a groove of the secondary coil 14 extending radially inwardly at the channel 60c on the bobbin 16. A part of the secondary coil 14 may be wound in the channel 60c, if outer diameters of parts of the secondary coil 14 wound on the channels 60b and 60d is larger than an outer diameter of the part of the secondary coil 14 wound in the channel 60c to form the groove of the secondary coil 14. Flanges 64a and 64b between the channels 60a and 60b and between the channels 60b and 60c have respective dent portions 64j through which an end of the secondary coil 14 extends from the channel 60a to the channel 60c. The end of the secondary coil 14 extending from the channel 60a to the channel 60c through the dent portions 64j of the flanges 64a and 64b is arranged apart and electrically insulated from the part of the secondary coil 14 wound in the channel 60b.

The bobbin 16 made of an electrically insulating material extends to form a bar-shaped secondary terminal fixing portion 62 under the channel 60c and under the flanges 64b and 64c, and to form a secondary terminal support portion 66 under a flange 64e between the channels 60e and 60f. A secondary terminal mounting member 22a is inserted vertically into the bar-shaped secondary terminal fixing portion 62 to be fitted tight therein, and a secondary terminal member 22b is fixedly mounted onto forward ends of the secondary terminal mounting member 22a and the secondary terminal support portion 66. The secondary terminal mounting member 22a and the secondary terminal member 22b are electrically connected with soldering to form a secondary terminal 22. The secondary terminal member 22b has a hole (not shown) for receiving connectively a forward end 20a of the high-voltage terminal rod 20 at a central portion thereof. The bar-shaped secondary terminal fixing portion 62, the secondary terminal support portion 66 and the secondary terminal 22 are arranged in the high-voltage tower 24.

Before the secondary coil 14 is wound on the bobbin in the order of channel 60h, channel 60g, channel 60f, channel 60e, channel 60d, channel 60b and channel 60a, the secondary terminal mounting member 22a is fixed to the secondary terminal fixing portion 62. The flanges 64a–64g between the channels 60a–60h have respective V-shaped recesses (not shown) through each of which the secondary coil 14 extends from one of the channels 60a–60h to adjacent one of channels 60a–60h. The secondary coil 14 extending from the channel 60a through the dent portions 64j and the channel 60c is wound on a plurality of channels 22c formed on the secondary terminal mounting member 22a. This winding operation of the secondary coil 14 is achieved automatically and continuously by a coil winding machine. Subsequently, the secondary terminal member 22b is adhered to both of the secondary terminal mounting member 22a and a part of the end of the secondary coil wound on the lowest one of the channels 22c with the soldering, and is fixed onto the secondary terminal support portion 66.

An annular tetragen iron core 72 received fixedly in a core case 60 made of an electrically insulating resin surrounds the bobbin 16. The iron core 72 forms a magnetic circuit for the primary coil 12 and the secondary coil 14, together with a central iron core 71. The core case 70 is formed integrally with the ignition coil frame 74 made of an electrically insulating resin. The bobbin 16 and so forth are received in the ignition coil frame 74 and an electrically insulating resin 76 are cured in the ignition coil frame 74 to surround the primary coil 12 and the secondary coil 14 and to fix the bobbin 16 and so forth to the ignition coil frame 74.

Since the channel 60c is arranged at an intermediate position of the bobbin 16, the secondary terminal 22 can be arranged at a central position of the ignition apparatus 10. Therefore, the secondary coil 14 can be electrically connected to the high-voltage extension member 30 arranged at the central position of the ignition apparatus 10 without a protrusion of the ignition coil frame 74 surrounding the high-voltage tower 24, and a size of the ignition apparatus 10 is sufficiently small for a mounting thereof on the internal combustion engine.

Figure 4:
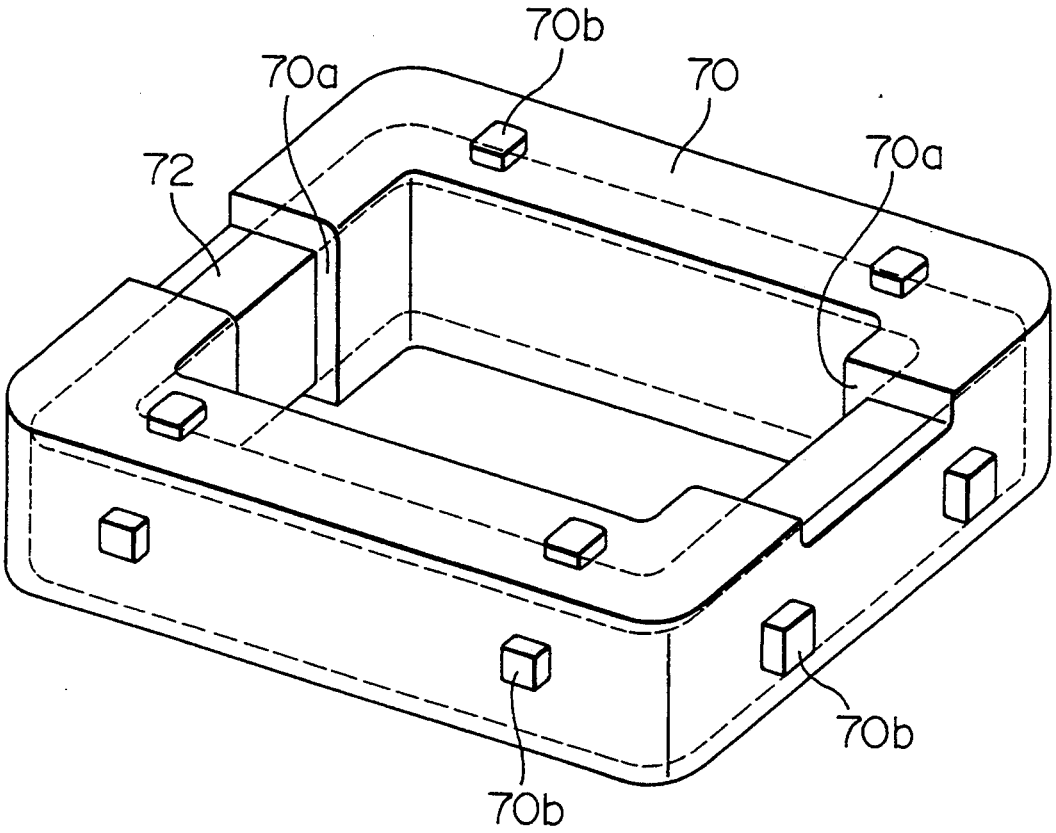
FIG. 4 is an oblique projection view showing an iron-core case used in the embodiment of the present invention.

As shown in FIG. 4, a pair of sides of the core case 70 opposite to each other has openings 70a at a central portion thereof to expose the iron core 72 to the outside of the core case 70 so that the central iron core 71 with the primary coil 12 therearound can contact directly with the iron core 72 in the openings 70a. A plurality of projections 70b extend integrally from an outer surface of the core case 70 made of an electrically insulating resin.

When the ignition coil frame 74 is formed in a molding process, the core case 70 receiving the iron core 72 is supported by the projections 70b in a mold (not shown) with a space between the mold and the core case 70. A liquid resin is poured into the space, and is cured therein to form the ignition coil frame 74 so that the ignition coil frame 74 is formed on and adhered to the ignition coil frame 74. When the ignition coil frame 74 is previously formed and subsequently the core case 70 is inserted into the ignition coil frame 74, a clearance therebetween is necessary for the insertion. In the present invention's structure, a clearance between the bobbin 16 and the ignition coil frame 74 is necessary, but the clearance between the ignition coil frame 74 and the core case 70 is not necessary.

When the iron core 72 is directly received in the ignition coil frame 74 without the core case 70 by use of the molding process, a portion on the iron core 72 for contacting with the mold to be supported therein is exposed to the outside of the ignition coil frame 74. Therefore, there is a possibility that the portion on the iron core 72 forms rust by water. In the present invention's structure, the projections 70b are exposed to the outside of the ignition coil frame 74, but the iron core 72 is wholly covered or protected by the core case 70 and the ignition coil frame 74. Therefore, there is no possibility that the iron core 72 forms rust by water and a boundary between the core case 70 and the ignition coil frame 74 is formed.

Figure 5:
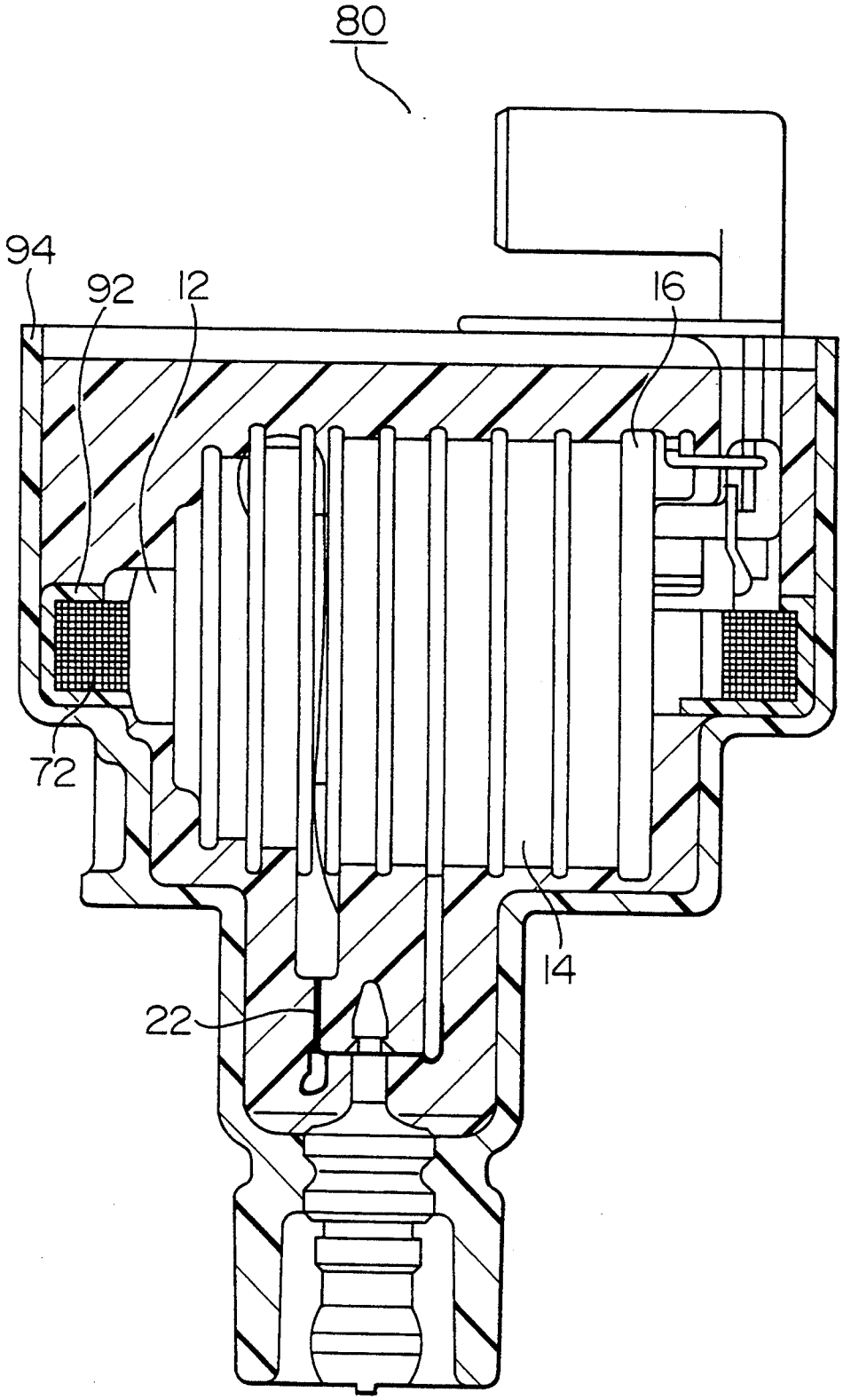
FIG. 5 is a partially cross-sectional view showing a part of another embodiment of the present invention.

As shown in FIG. 5, a conventional type core case 92 without the projections 70b may be used in another ignition apparatus 80. In the ignition apparatus 80, after an ignition coil frame 94 is formed with a space for receiving the core case 92, the core case 92 is inserted into the space of the ignition coil frame 94. Although a size of the ignition apparatus 80 is larger than that of the ignition apparatus 10, in the ignition apparatus 80, the secondary terminal 22 can be arranged under the intermediate position of the bobbin 16, and the secondary coil 14 can be wound by the coil winding machine. Further, it is not necessary for the core case 92 to be supported in the mold with a space therebetween when the ignition coil frame 94 is formed. Therefore, the ignition coil frame 94 can be easily formed.

The iron core 72 may be directly received in and be adhered to the ignition coil frame 74 in the molding process of the ignition coil frame 74. In this case, the secondary terminal 22 can be arranged under the intermediate position of the bobbin 16, and the secondary coil 14 can be wound by the coil winding machine. The channel of the bobbin 16 on which the secondary coil 14 is not wound or a number of coil turns of the secondary coil 14 is smaller than that of the secondary coil 14 on each of the other channels may be arranged at any position on the outer periphery of the bobbin 16. Accordingly, the secondary terminal 22 may be arranged under any position on the outer periphery of the bobbin 16. Even when a depth of the channel 60c is smaller than that of each of the other channels on the bobbin 16, the secondary coil 14 can be wound on the bobbin 16.

Figure 6:
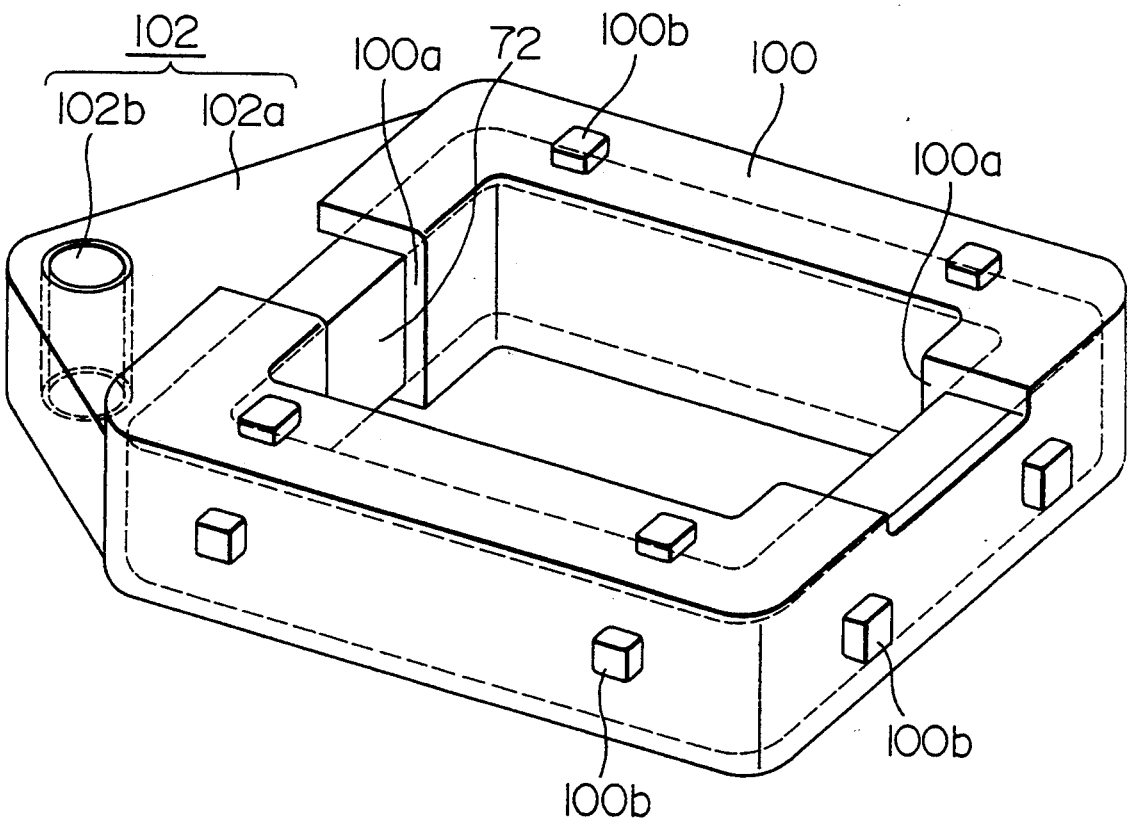
FIG. 6 is an oblique projection view showing another iron-core case used in the embodiment of the present invention.

As shown in FIG. 6, a core case 100 which is a modification of the core cases 70 and 92 may have a mounting portion 102 for the mount on the internal combustion engine. The core case 100 has openings 100a and projections 100b as the core case 70. The mounting portion 102 projects from an outer periphery of a side of the core case 100 and includes a triangle thick portion 102a and a hole 102b arranged at a forward end of the triangle thick portion 102a. A metal cylindrical collar is inserted and adhered into the hole 102b to reinforce a compression strength of the hole 102b. When the ignition coil frame 74 is formed in the molding process, the mounting portion 102 projecting therefrom is formed simultaneously. The ignition coil frame 74 with the mounting portion 102 can be easily mounted on the internal combustion engine by a bolt through the hole 102b. If the secondary coil 14 is wound in the order of the channels 60h–60d, the channels 60b–60a and the secondary terminal 22 after the secondary terminal 22 is fixed under the channel 60c, the secondary coil 14 can be wound automatically by the coil winding machine.

Figure 8:
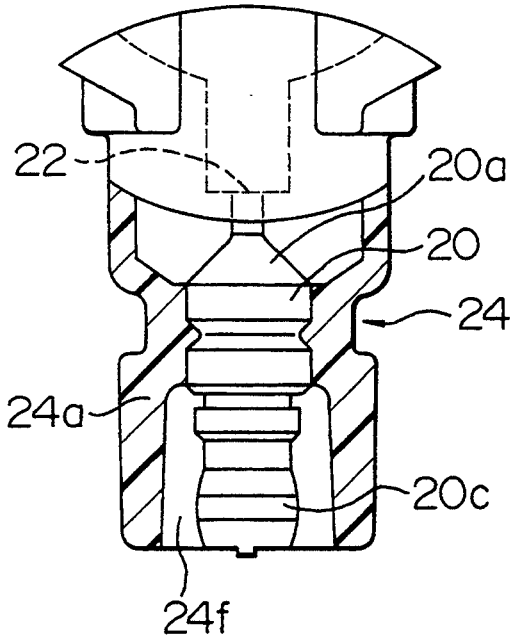
FIG. 8 is a partially cross-sectional view showing a high-voltage tower used in the embodiment of FIG. 1.
Figure 9:
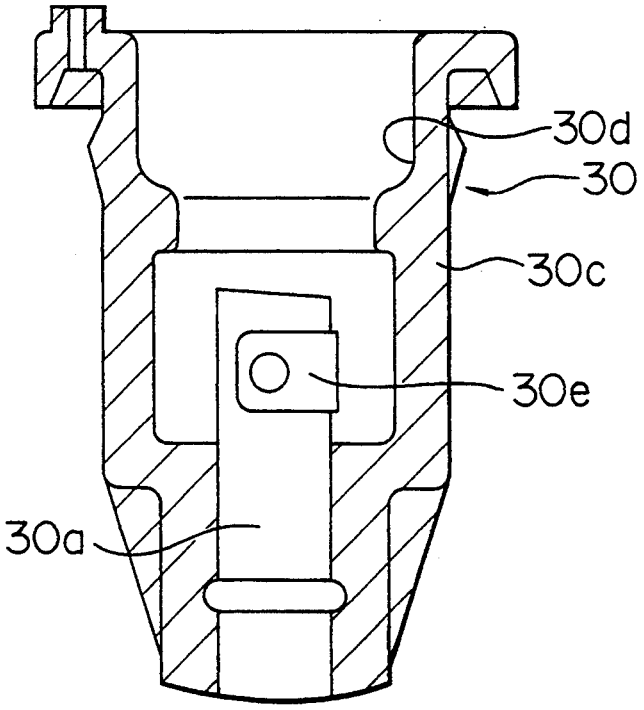
FIG. 9 is a partially cross-sectional view showing a part of a high-voltage extension member used in the embodiment of FIG. 2.

In a connection between a high-voltage terminal rod 20 and the high voltage extension member 30, as shown in FIGS. 8 and 9, a high-voltage tower 24 has a cylindrical portion 24a receiving the high-voltage terminal rod 20. The high-voltage terminal rod 20 has an end 20a extending to the secondary terminal 22, and another end 20c connected to a cylindrical metal member 30a. A clearance 24b is formed between the high-voltage terminal rod 20 and the high-voltage tower 24 to improve the electrical insulating characteristic therebetween. A rubber pipe 30c of the high-voltage extension member 30 has a circular recess 30d receiving the high-voltage tower 24.

Instead of the coil spring 32, a plate spring, an electrically conductive high-elasticity rubber or the like may be used. The end portion 32a contacting with the spark plug 80 to supply the electricity thereto may be separated from the spring portion 32c which can be bent freely and elastically between the first and second cylindrical metal members 30*a* and 30*b*. A plurality of the spring portions 32*c* may be included by the high-voltage extension member 30 so that the high-voltage extension member 30 can be bent freely and elastically at a plurality of portion where the spring portions 32*c* are arranged. A number of coil turns or coil turn rate of the secondary coil 14 per a predetermined length in a longitudinal direction of the secondary coil 14 at the intermediate position of the outer periphery of the secondary coil 14 may be smaller than a number of coil turns or coil turn rate of the secondary coil 14 per the predetermined length in the longitudinal direction of the secondary coil at portions adjacent to the intermediate position of the outer periphery of the secondary coil 14 so that the groove 60*c* is formed at the intermediate position of the outer periphery of the secondary coil 14. The longitudinal direction of the secondary coil 14 is substantially parallel to the outer periphery of the secondary coil 14.

What is claimed is:

1. An ignition apparatus for providing a peaked high-voltage current to a spark plug in an internal combustion engine, said apparatus comprising:

an ignition coil for generating a peaked high-voltage output from a predetermined input-current decrease; and a bendable extension member including a first portion extending from the ignition coil, a second portion adapted to be connected to the spark plug, and an elastic member operably engaging the first and second portions in a manner which enables relative movement between said first and second portions upon flexion of said elastic member.

2. An ignition apparatus according to claim 1, wherein the elastic member comprises a coil spring.

3. An ignition apparatus according to claim 1, wherein the first and second portions include respective metallic cylindrical members.

4. An ignition apparatus according to claim 1, wherein the elastic member includes a coil spring comprising tightly wound coil turns contacting one another.

5. An ignition apparatus for providing a peaked high-voltage current to a spark plug in an internal combustion engine, comprising:

an ignition coil including a primary coil, and a secondary coil for generating a peaked high-voltage output from a predetermined input-current decrease in the primary coil, said secondary coil comprising conductor windings disposed about said primary coil in such fashion which provides said secondary coil with a groove formed by a discontinuity in said windings; and an extension member adapted to supply the peaked high-voltage output from the secondary coil to the spark plug, said extension member being electrically connected to said secondary coil through said groove so that the peaked high-voltage output is transmitted from the secondary coil through the groove to the extension member.

6. An ignition apparatus according to claim 5, wherein the apparatus further comprises a bobbin which includes a plurality of annular channels on which the secondary coil is wound, said groove of the secondary coil being formed at any of said channels intermediate opposite ends of said secondary coil.

7. An ignition apparatus according to claim 6, wherein a width of the channel at which said groove is formed is smaller than a width of other of said channels.

8. An ignition apparatus according to claim 6, wherein an end of the conductor windings extends into the groove without contacting other portions of the secondary coil, said end extending in an axial direction of said bobbin through a dent in said bobbin and into said groove.

9. An ignition apparatus according to claim 8, wherein the end of the secondary coil extending into the groove is disposed in spaced relation from the outer periphery of the secondary coil to form a clearance therebetween.

10. An ignition apparatus according to claim 5, wherein an end of the conductor windings is connected to the extension member at a position spaced apart from an outer periphery of the secondary coil.

11. An ignition apparatus for providing a peaked high-voltage current to a spark plug in an internal combustion engine, said apparatus comprising:

an ignition coil including a primary coil, a secondary coil for generating a peaked high-voltage output from an abrupt input-current decrease in the primary coil, and a core assembly including (i) a central core on which the primary and secondary coils are wound, and (2) an outer core surrounding the central core, said core assembly forming a magnetic circuit for the primary and secondary coils;

an extension member extending from the ignition coil and adapted to provide the peaked high-voltage output to the spark plug;

an electrically insulating resin core case surrounding said outer core; and an ignition coil frame surrounding the electrically insulating resin core case and generally disposed about the central core and the primary and secondary coils.

12. An ignition apparatus for providing a peaked high-voltage current to a spark plug in an internal combustion engine, said apparatus comprising:

an ignition coil including a primary coil, and a secondary coil for generating a peaked high-voltage output from a predetermined input-current decrease in the primary coil, said secondary coil comprising conductor windings disposed about said primary coil in such fashion which provides said secondary coil with a groove formed by a discontinuity in said windings; and a bendable extension member including a first portion extending from the ignition coil, a second portion adapted to be connected to the spark plug, and an elastic member operably engaging the first and second portions in a manner which enables relative movement between said first and second portions upon flexion of said elastic member, said extension member being electrically connected to said secondary coil through said groove so that the peaked high-voltage output is transmitted from the secondary coil through the groove to the extension member.

13. An ignition apparatus according to claim 4, wherein the ignition coil comprises a primary coil, a bobbin including an inner periphery for receiving the primary coil and an outer periphery defining a plurality of channels, a secondary coil being wound on the bobbin in each of said channels except a predetermined one of the channels intermediately disposed between two opposing end channels among the plurality of channels, said secondary coil capable of generating said peaked high-voltage output from the predetermined input-current decrease in the primary coil, and a terminal fixed to the bobbin at the predetermined one of said channels and through which the peaked high-voltage output is provided to the first portion of the extension member, said terminal being electrically connected to an end of said secondary coil through the predetermined one of said channels.

14. An ignition apparatus according to claim 4, wherein the ignition coil comprises a primary coil, a secondary coil for generating the peaked high-voltage output from the predetermined input-current decrease of the primary coil, a core forming a magnetic circuit for the primary and secondary coils, an electrically insulating resin core case surrounding the core, an ignition coil frame surrounding the core case and generally disposed about the primary and secondary coils, and an electrically insulating resin disposed in the coil frame and surrounding an outer periphery of the primary and secondary coils.

15. An ignition apparatus according to claim 13, wherein the ignition coil further comprises a core forming a magnetic circuit for the primary and secondary coils, an electrically insulating resin core case surrounding the core, an ignition coil frame surrounding the core case and generally disposed about the primary and secondary coils, and an electrically insulating resin disposed in the coil frame and surrounding an outer periphery of the primary and secondary coils.

16. An ignition apparatus for providing a peaked high-voltage current to a spark plug in an internal combustion engine, said apparatus comprising:

an ignition coil for generating a peaked high-voltage output from a predetermined input-current decrease; and an extension member including a first cylindrical metal portion extending from the ignition coil, a second cylindrical metal portion adapted to be connected to the spark plug, and an elastic member operably engaging the first and second portions to enable relative movement therebetween, said elastic member including (i) an intermediate coil spring portion with an outer diameter substantially equal to outer diameters of the first and second cylindrical metal portions, said intermediate coil spring portion having tightly wound coil turns contacting one another, and (ii) two coil spring portions having outer diameters slightly smaller than inner diameters of said first and second portions, said two coil spring portions having loosely wound coil turns disposed in spaced relation from one another.

17. An ignition apparatus according to claim 16, wherein the first and second cylindrical metal portions each comprise at least one nail engaging a respective one of said two coil spring portions.

* * * * *